US011628595B2

(12) United States Patent
Boersch et al.

(10) Patent No.: US 11,628,595 B2
(45) Date of Patent: Apr. 18, 2023

(54) TOOL AND DEVICE FOR REMOVAL OF MATERIAL ON SURFACES

(71) Applicant: EnBW Energie Baden-Wuerttemberg AG, Karlsruhe (DE)

(72) Inventors: Fabian Boersch, Weinsberg (DE); Kevin Dietz, Herdorf (DE); Hartmut Feil, Schefflenz (DE); Johannes Greb, Alsdorf (DE); Fabian Hammer, Betzdorf (DE)

(73) Assignee: EnBW Energie Baden-Wuerttemberg AG, Karlsruhe (DE)

( * ) Notice: Subject to any disclaimer, the term of this patent is extended or adjusted under 35 U.S.C. 154(b) by 398 days.

(21) Appl. No.: 16/343,221

(22) PCT Filed: Nov. 2, 2017

(86) PCT No.: PCT/EP2017/078077
§ 371 (c)(1),
(2) Date: Nov. 19, 2019

(87) PCT Pub. No.: WO2018/083184
PCT Pub. Date: May 11, 2018

(65) Prior Publication Data

US 2020/0130230 A1 Apr. 30, 2020

(30) Foreign Application Priority Data

Nov. 2, 2016 (DE) ..... 10 2016 120 852.3

(51) Int. Cl.
*E01C 23/09* (2006.01)
*B28D 1/04* (2006.01)
(Continued)

(52) U.S. Cl.
CPC ..... *B28D 1/048* (2013.01); *B28D 1/121* (2013.01); *E01C 23/09* (2013.01); *B28D 7/02* (2013.01); *G21D 1/003* (2013.01)

(58) Field of Classification Search
CPC .. E01C 23/09; B28D 1/02; B28D 1/04; B28D 1/044; B28D 1/047; B28D 1/048; B28D 1/12; B28D 1/06; B28D 1/062; B28D 1/064
USPC ..... 299/39.3; 125/13.01, 15; 404/93–94
See application file for complete search history.

(56) References Cited

U.S. PATENT DOCUMENTS 4,664,447 A * 5/1987 Clark ..... E04D 15/003 144/218
4,870,946 A 10/1989 Long et al.
(Continued)

FOREIGN PATENT DOCUMENTS

DE 3121130 A1 12/1982
DE 19837288 A1 2/2000
(Continued)

OTHER PUBLICATIONS

German Language—Search Report of Patentability, PCT/IPEA/416, International Application No. PCT/EP2017/078077 pp. 1-18, dated Oct. 11, 2018.
(Continued)

*Primary Examiner* — Sunil Singh
(74) *Attorney, Agent, or Firm* — George McGuire

(57) ABSTRACT

The invention proposes a tool and device, with the aid of which it is possible to remove the surface of walls, ceilings and floors also in the corners of contaminated interiors.

9 Claims, 12 Drawing Sheets

(51) Int. Cl.

| | |
|---|---|
| ***B28D 1/12*** | (2006.01) |
| *B28D 7/02* | (2006.01) |
| *G21D 1/00* | (2006.01) |

(56) References Cited

U.S. PATENT DOCUMENTS

| | | | | |
|---|---|---|---|---|
| 5,429,109 | A | 7/1995 | Chiuminatta et al. | |
| 6,099,080 | A * | 8/2000 | Hirashita ..... | E01C 23/088 404/93 |

FOREIGN PATENT DOCUMENTS

| | | | |
|---|---|---|---|
| DE | 69328422 | T2 | 1/2001 |
| DE | 102010038503 | A1 | 2/2012 |
| DE | 202012002545 | U1 | 7/2012 |
| DE | 102014210947 | B3 | 7/2015 |
| WO | 0010785 | A1 | 3/2000 |
| WO | 2012022508 | A1 | 2/2012 |
| WO | 2015185739 | A1 | 12/2015 |

OTHER PUBLICATIONS

German Exam Report of application 10 2016 120 852.3, pp. 1-6, dated Sep. 20, 2017.

International Search Report and Written Opinion Form PCT/ISA 210 and PCT/ISA 237, PCT/EP2017/078077, pp. 1-8, International Filing Date Nov. 2, 2017, dated Jan. 12, 2018.

Fachverband Betonbohren Und—Sägen: Handbuch Betonbohren und—sägen. 2. Aufl. Bad Arolsen: Fachberg. Betonbohren unde—sägen Deutschland e.V., 2010. Titelseite + Inhaltsverzeichnis + S. 91-100.—ISBN 3-00-005845-1, Feb. 13, 2017.

* cited by examiner

TOOL AND DEVICE FOR REMOVAL OF MATERIAL ON SURFACES

CROSS REFERENCE TO RELATED APPLICATIONS

The present application is the United States National Stage Application of International Application No. PCT/EP2017/078077, filed Nov. 2, 2017, which claims priority to German patent application No. 10 2016 120 852.3, filed on Nov. 2, 2016, the entire contents of which each of which are incorporated herein by reference.

BACKGROUND OF THE INVENTION

The present invention relates to a tool and a device for the removal of contaminated material from a wall.

When dismantling nuclear facilities, minimizing contaminated waste is a top priority. This also applies to an efficient decontamination of floors and walls of buildings made of concrete, which protect the nuclear facility or parts thereof from external influences.

Within the context of the claimed invention, for reasons of linguistic simplification, it primarily will be talked about a wall; however, the floors and ceilings of rooms and other surfaces are always meant as well. The use of the present invention is not limited to decontamination.

During the operation of nuclear facilities, in some cases for decades, a contamination of the interior boundary surfaces (walls, floor and ceiling) of the building protecting the nuclear plant may result. For this reason, such buildings must be decontaminated after terminating the nuclear use. The decontamination includes the removal of surfaces of the inner boundary surfaces (walls, floor and ceiling) to a depth of approximately 10 mm to 20 mm. Only the material removed in this process can possibly include radioactive particles and is to be separately disposed.

The remainder of the decontaminated building can either be continuously used or be demolished in a conventional manner such as any other building.

From DE 10 2014 210 947 B2 and the subsequently published DE 10 2016 117 163 A1 devices and a method for the removal of surfaces are known. These devices are particularly suitable for the removal of large areas. However, these devices cannot be used in corners. A corner refers to the area in which two walls converge or where the floor intersects with a wall or a wall with the ceiling.

From DE 10 2014 210 947 B2 and the subsequently published DE 10 2016 117 163 A1 devices and a method for the removal of surfaces are known. These devices are particularly suitable for the removal of large areas. However, these devices cannot be used in corners. A corner refers to the area in which two walls converge or where the floor intersects with a wall or a wall with the ceiling.

From DE 31 21 130 A1 and DE 10 2010 0389 503, a circular saw head having two circular saw blades disposed at a distance to each other is known. In DE 31 21 130 A1, the circular saw blades are installed on a carrying sleeve. In turn, the carrying sleeve is slid onto a saw shaft and is fastened with the aid of a central nut. DE 10 2010 0389 503 only includes very few constructive details.

SUMMARY OF THE INVENTION

The object of the present invention is to provide a tool and a device, with the aid of which it is possible to efficiently and quickly remove the surface of a wall, the floor or the ceiling even in these corners.

According to the present invention, this object is achieved by a tool for the removal of surfaces.

In so doing, it is possible to reach all the way into the corners of a room using the tool according to the present invention, and to there remove the surface of the wall, the floor or the ceiling. If one uses the tool according to the present invention on both surfaces forming a corner, the surface in the region of the corners can be completely removed. This means that no "leftover" remains, which would have to be laboriously removed manually or otherwise.

In terms of manufacturing technology, the tool according to the present invention can be implemented in a relatively easy manner. The drive shaft can be realized as a turned part. On the cylindrical surface of this drive shaft, one or a plurality of longitudinal grooves can be introduced, which are disposed by corresponding projections or lugs on the inner hole of the saw blades or by spacer rings acting between the saw blades in such a manner that a rotationally fixed and positive connection results. Thereby, the torque required for treating the surface can be easily and reliably transferred from the drive shaft to the saw blades. The axial distance between the saw blades can be adjusted by spacer rings.

The tool according to the present invention, includes the drive shaft, at least one longitudinal groove and a collar. Spacer rings are disposed between the saw blades, and the spacer rings and/or the saw blades have through holes. As a result, these components, with the aid of clamping bolts and in relation to a collar of the drive shaft, are fixed and braced to each other. The replacement of worn saw blades is very simple and, with the exception of the last saw blade, commercially common saw blades can be used.

The torque transmission is carried out via one or a plurality of lugs, which are configured at a central opening of the spacer rings and are formed in a complementary manner to the longitudinal groove or grooves of the drive shaft.

In a further advantageous embodiment, the clamping bolts interact with fastening means, in particular internal threads, at one of the collars of the drive shaft or at a clamping piece slid onto the drive shaft. In so doing, the saw blades and the spacer rings are fixed in the axial direction on the drive shaft and are connected to the drive shaft in a rotationally fixed manner.

In an advantageous embodiment of the present invention, it is provided that the last saw blade is centered and/or rotatably fixedly attached on an end face at the second end of the drive shaft. For example, it is possible that at the second end of the drive shaft, a ledge is present, which is used for centering the last saw blade. The last saw blade can then be fastened with the aid of screws, which are screwed into threaded holes on the end face at the second end of the drive shaft.

Alternatively, the saw blades can be braced via a central nut to the drive shaft.

It is also possible that at least the last saw blade has a crank, meaning that in cross section it has a pot-like contour. It is thereby possible that the last saw blade, such as the other saw blades, is also slid onto the drive shaft. Owing to the crank, the teeth of the last saw blade still project in the axial direction beyond the second end of the drive shaft. This embodiment is very easily realized in terms of manufacturing technology.

Of course, the other saw blades of the tool according to the present invention can also have a crank.

The saw teeth can be made from all suitable cutting materials. In particular, the saw teeth can be made of hard metal (coated or uncoated). Alternatively, diamond can be used as a cutting material.

The object mentioned at the outset is likewise achieved by a device for removing surfaces including a base frame, a linear guide and a sliding carriage, the sliding carriage being connected via the linear guide to the base frame, and, according to one of the preceding claims, a tool for removing material is disposed at the sliding carriage.

With the aid of this device, it is possible to first bring the actuated tool into a working position, so that the tool immerses into the surface to be machined. Subsequently, the sliding carriage, at which the rotating tool is located, is moved parallel to the surface to be removed. This results in a strip-like removal of the surface in the area of the corner to be machined.

The device according to the present invention is relatively simply constructed and is very robust. The device makes it possible to remove longer sections, depending on the length of the linear guide having, for example, a length of 50 cm to 1.5 m, in one piece and, thereby, to quickly and efficiently remove the surface in the corners of contaminated rooms.

It has proven to be advantageous if a bearing unit and/or a drive for the tool are provided at the sliding carriage. This results in a very compact and robust construction of the device according to the present invention.

In order to be able to carry out the feed movement of the tool along the linear guide in an automated manner, a linear drive for moving the sliding carriage in relation to the base frame is provided. All drives known from the field of construction machinery or machine tools can be considered as linear drives. In particular, hydraulic drives, pneumatic drives, electromechanical drives, such as a threaded spindle and an electric motor, can be used.

So that the tool according to the present invention can work into the corners, it is provided that the tool by its second end projects laterally beyond a longitudinal side of the base frame. The linear guide is situated parallel to the longitudinal side of the base frame. In so doing, it is possible to move the tool parallel to a longitudinal side of the base frame and, thereby to remove the surface in the corner of a room.

In a further advantageous embodiment of the present invention, it is provided that the saw blades of the tool at least in an end position of the sliding carriage project beyond an end face of the base frame.

In order to be able to easily handle the base frame and, thus, the entire device, a mechanical interface is provided on the base frame. This mechanical interface makes it possible to attach the device according to the present invention, for example, to the arm of an excavator or another construction machine or the arm of a robot. With the aid of the excavator or robot arm, the device according to the present invention is moved to the site of operation and is kept in this location also during the machining of a surface.

If the device according to the present invention is used successively at both areas forming a corner, it is possible to completely remove the surface in the corner. The same applies to corners of a room where three areas (for example, two walls and the ceiling) intersect. This is not possible using devices known from the prior art.

In a further advantageous embodiment of the present invention, it is provided that the base frame has a plurality of spacers. These spacers serve to easily move the tool to a suitable distance from the surface to be machined. The spacers to some extent act like feet, by which the device is placed on the surface to be machined.

An advantageous embodiment of the spacer provides that the spacers have a spring-loaded pin or the like, and that a spring deflection of the pins is greater than the depth of immersion of the tool into the surface to be machined.

Furthermore, an (adjustable) length of the spacers is advantageously dimensioned in such a manner that, if the pins in the decompressed state rest on the surface to be removed, the saw blades of the tool do not immerse into the surface to be removed. In so doing, the tool is positioned in the place to be machined in the corner of a room. If the device, when the tool is rotating, is now pressed with the aid of an excavator arm or a robot arm against the spring force of the pins closer to the surface to be machined, the tool or the saw blades of the tool immerse into the surface to be machined until the spacers rest "firmly" on the surface to be machined. Then the saw blades of the tool have the desired depth of immersion, for example, of 10 mm, and the feed movement starts in that the linear drive of the device according to the present invention is actuated.

This very simple arrangement enables to position the device at the surface to be machined and to immerse the saw blades of the tool into the surface in a simple and uncomplicated manner.

Further advantages and advantageous embodiments of the present invention can be gathered from the subsequent drawing, its description and the patent claims.

DETAILED DESCRIPTION

Figure 1:
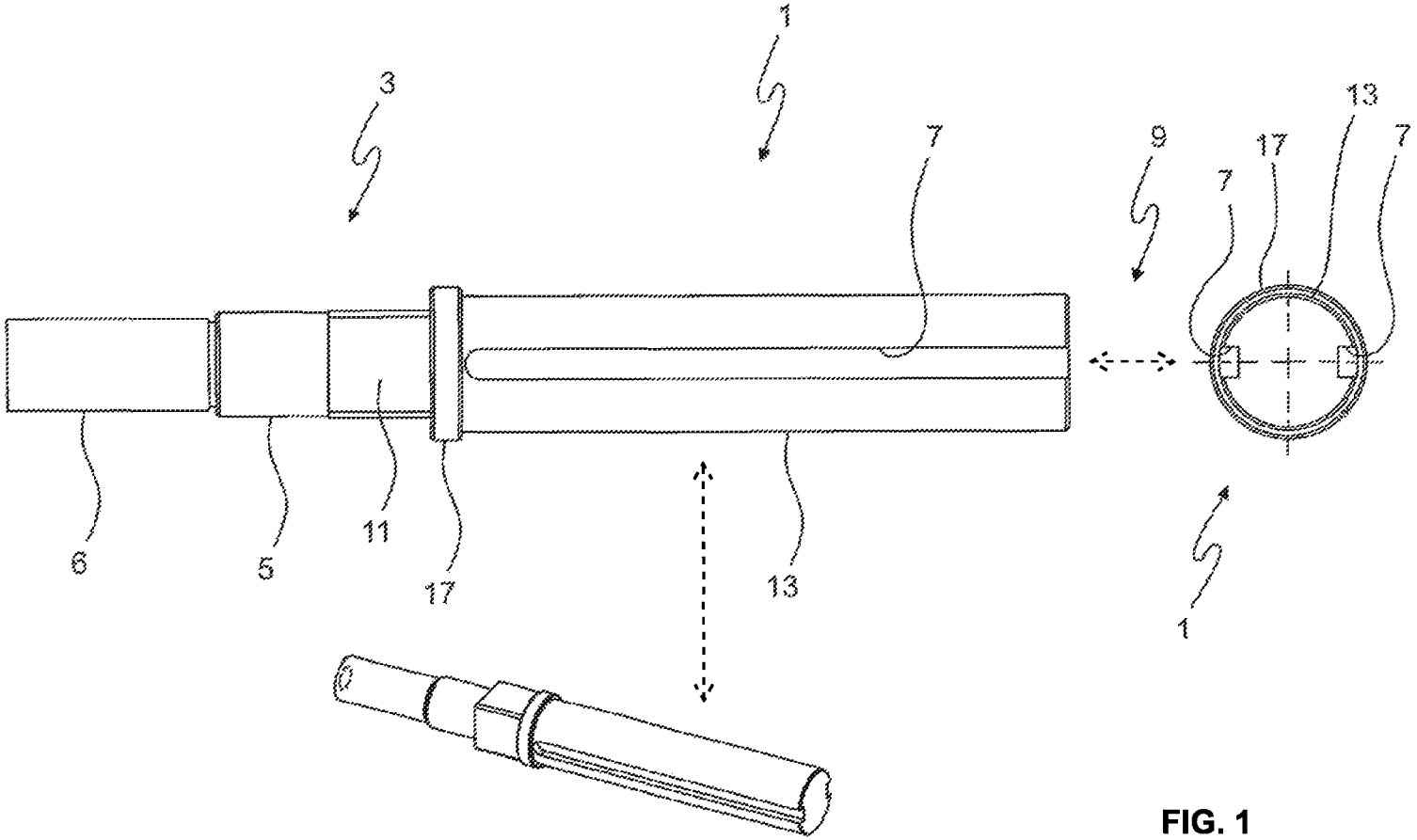
FIGS. 1A-1C show an exemplary embodiment of a drive shaft of a tool according to the present invention.

FIGS. 1A-1 C show schematically an exemplary embodiment of a drive shaft 1 according to the present invention in a side view and in a front view.

Drive shaft 1 has a first end 3. There, drive shaft 1 is rotatably mounted (not shown). The mounting can, for example, be carried out via a bearing pin 5, which is connected via a bearing block (not shown) to a sliding carriage of the device according to the present invention.

There are various design options to carry out this mounting. Usually, rolling bearings are disposed between drive shaft 1 and the bearing block.

In the region of first end 3 of drive shaft 1, a stub shaft 6 is moreover provided, via which drive shaft 1 is actuated. This actuation may, for example, be via a flexible shaft (not shown), an electric motor, a hydraulic motor or any other rotary drive known from the prior art.

A plurality of saw blades (not shown in the FIG. 1) can be slid onto drive shaft 1, which may have a cylindrical outer contour. The saw blades have to be centered and it is necessary to establish a rotationally fixed connection between the saw blades (not shown) and drive shaft 1. A very simple and reliable exemplary embodiment of such a rotationally fixed connection can be realized in that one or two longitudinal grooves 7 are introduced into the drive shaft. Longitudinal grooves 7 start from a second end 9 of drive shaft 1 and extend not quite all the way to first end 3 of drive shaft 1. Longitudinal grooves 7 are clearly visible in the front view in the left part of FIG. 1C. The outer diameter of drive shaft 1 is denoted with reference character 13.

An optional square 11 and a collar 17 are disposed between bearing pin 5 and (cylindrical) section 13. Not shown in the FIG. 1 is a clamping piece which is slid over stub shaft 6, bearing pin 5 and square 11 against collar 17. In the clamping piece, threaded holes are present, the hole pattern of which matches the hole patterns of saw blades 19, 25 and spacer rings 33. Details of the clamping piece are disclosed in FIG. 13 and its description.

Figure 2:
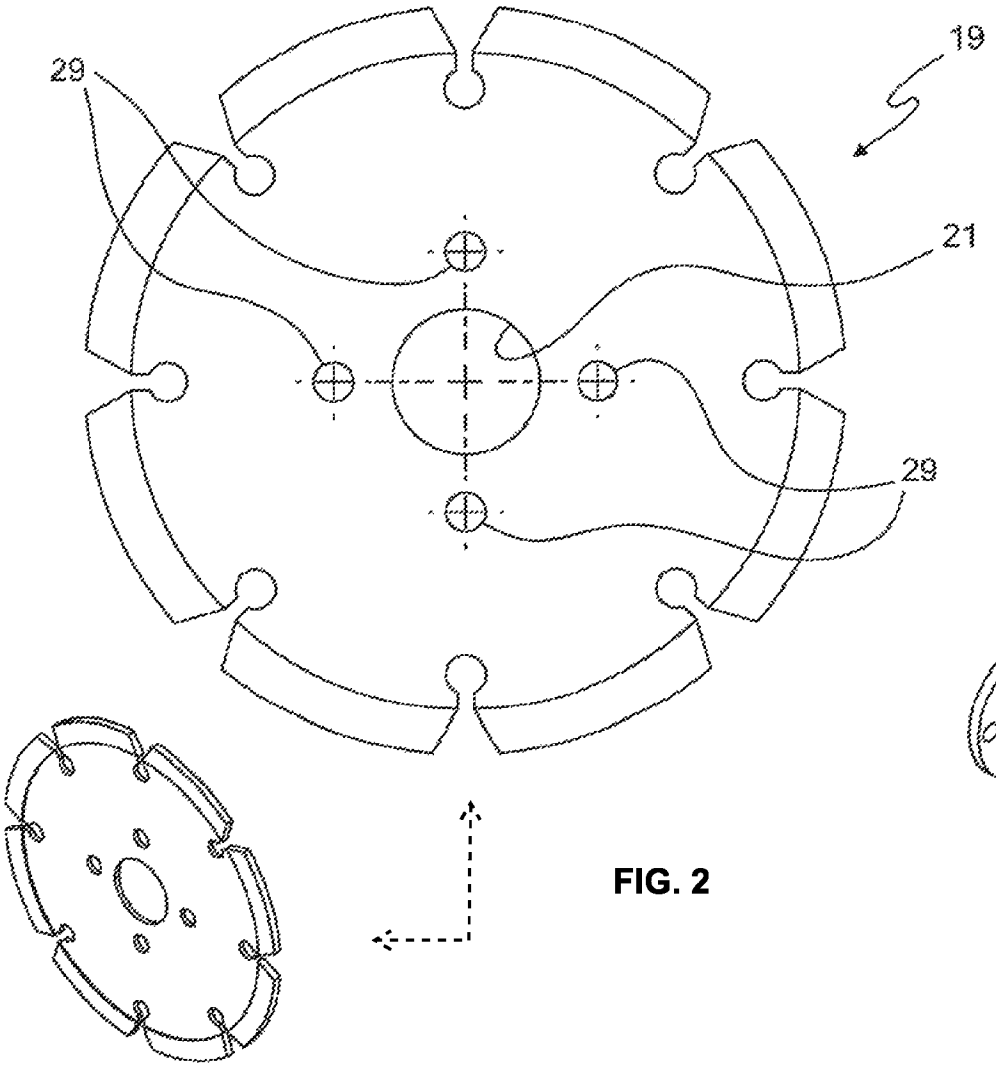
FIGS. 2A-2B show an embodiment of a saw blade.

In FIGS. 2A-2B, one of a plurality of grinding disks or saw blades 19, which are slid onto drive shaft 1, is illustrated in an exemplary manner. The grinding disk or saw blade 19 is shown only schematically.

Saw blade 19 or the grinding disks has/have a central opening 21, the shape and dimensions of which are matched to outer diameter 13 of drive shaft 1 in such a way that a plurality of saw blades 19 can be slid onto drive shaft 1.

With the exception of last saw blade 25, saw blade 19 or the grinding disks are commercially available on the market.

Figure 3:
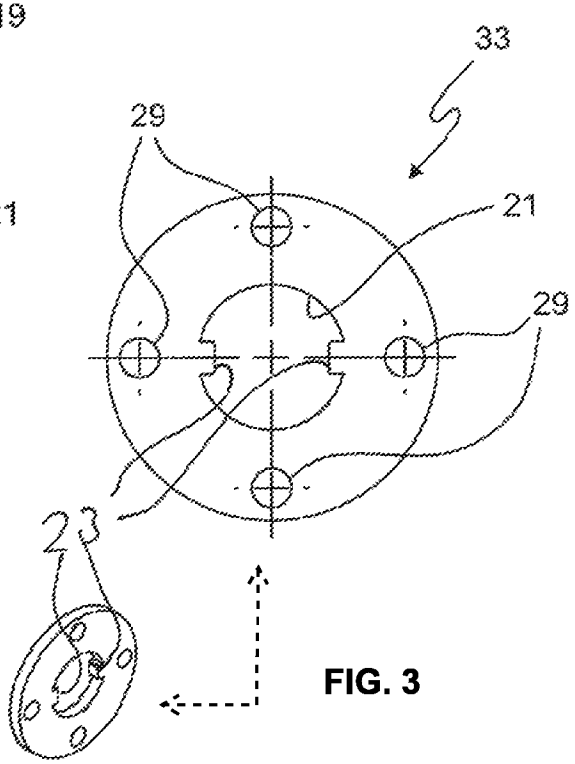
FIGS. 3A-3B show an embodiment of a spacer ring.

FIGS. 3A-3B show a spacer ring 33. As saw blades 19, the spacer ring has a central opening 21, the form and dimensions of which are matched to outer diameter 13 of drive shaft 1. At opening 21 of spacer ring 33, lugs 23 are configured, which positively interact with grooves 7 of drive shaft 1.

Saw blades 19, 25 and the spacer rings 33 have a plurality of through holes 29, so that clamping screws cannot be inserted through through holes 29 of saw blades 25 and of spacer rings 33.

Figure 4:
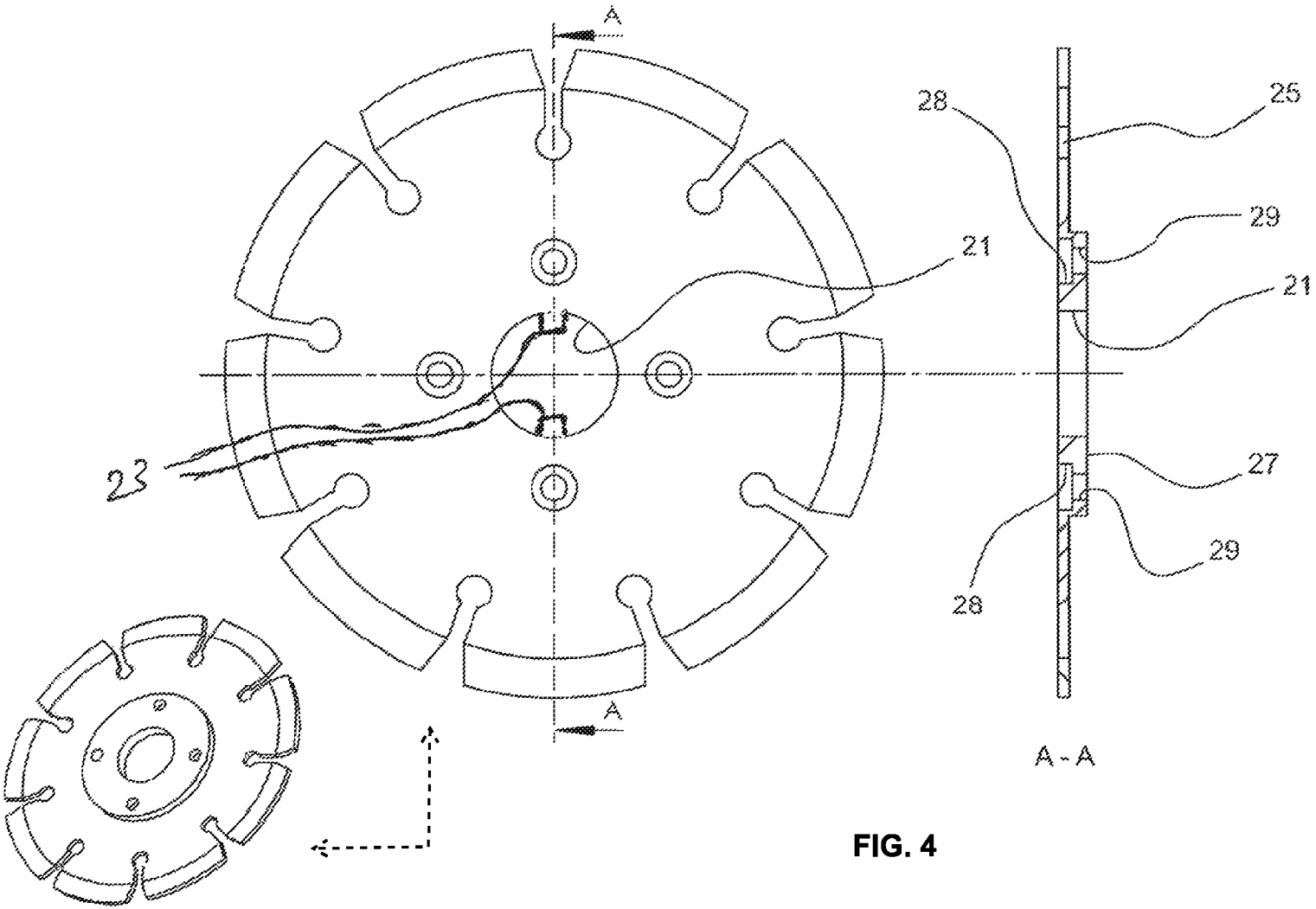
FIGS. 4A-4C show a second embodiment of a saw blade, with FIG. 4B being a cross-section taken along line A-A of FIG. 4A.

FIGS. 4A-4C show a further exemplary embodiment of last saw blade 25 according to the present invention. The outer diameter of last saw blade 25 is usually of equal size as the outer diameter of other saw blades 19.

In this exemplary embodiment, last saw blade 25 has a ledge 27 at the center. Central opening 21 and through holes 29 are located within ledge 27. By sliding last saw blade 25 onto diameter 13 of drive shaft 1, last saw blade 25 is centered. The at least one optional lug 23 of saw blade 25 corresponds to lugs 23 of spacer rings 33. The lugs engage into the at least one longitudinal groove 7 of drive shaft 1 and, for this reason, establish a rotationally fixed connection between saw blade 25 and drive shaft 1.

Through holes 29 of last saw blade 25 are provided with sinkings 28, which accommodate a screw head of the clamping screws, not shown. As a result, the screw heads do not project in the axial direction beyond last saw blade 25.

This configuration of last saw blade 25 and drive shaft 1 makes it possible to brace, with the aid of last saw blade 25 and screws inserted through through holes 29 and screwed into the threaded holes of clamping piece 30, all saw blades 19, 25 and spacer rings 33 to one another and to drive shaft 1. This situation is shown schematically in FIG. 5. The simplified screws illustrated as dash-dotted lines are denoted with reference character 31. The heads of the screws are accommodated in sinking 28 of last saw blade 25 so that they in the axial direction do not project beyond the teeth of last saw blade 25.

If screws 31 are tightened, all saw blades 19 and 25 are braced against each other in the axial direction. The torque is transmitted via longitudinal groove 7 and lugs 23 and by a non-positive connection between saw blades 19, 25 and spacer rings 33. For this reason, a rotationally fixed connection between saw blades 19 and 25 on the one hand and drive shaft 1 on the other hand is ensured.

Figure 5:
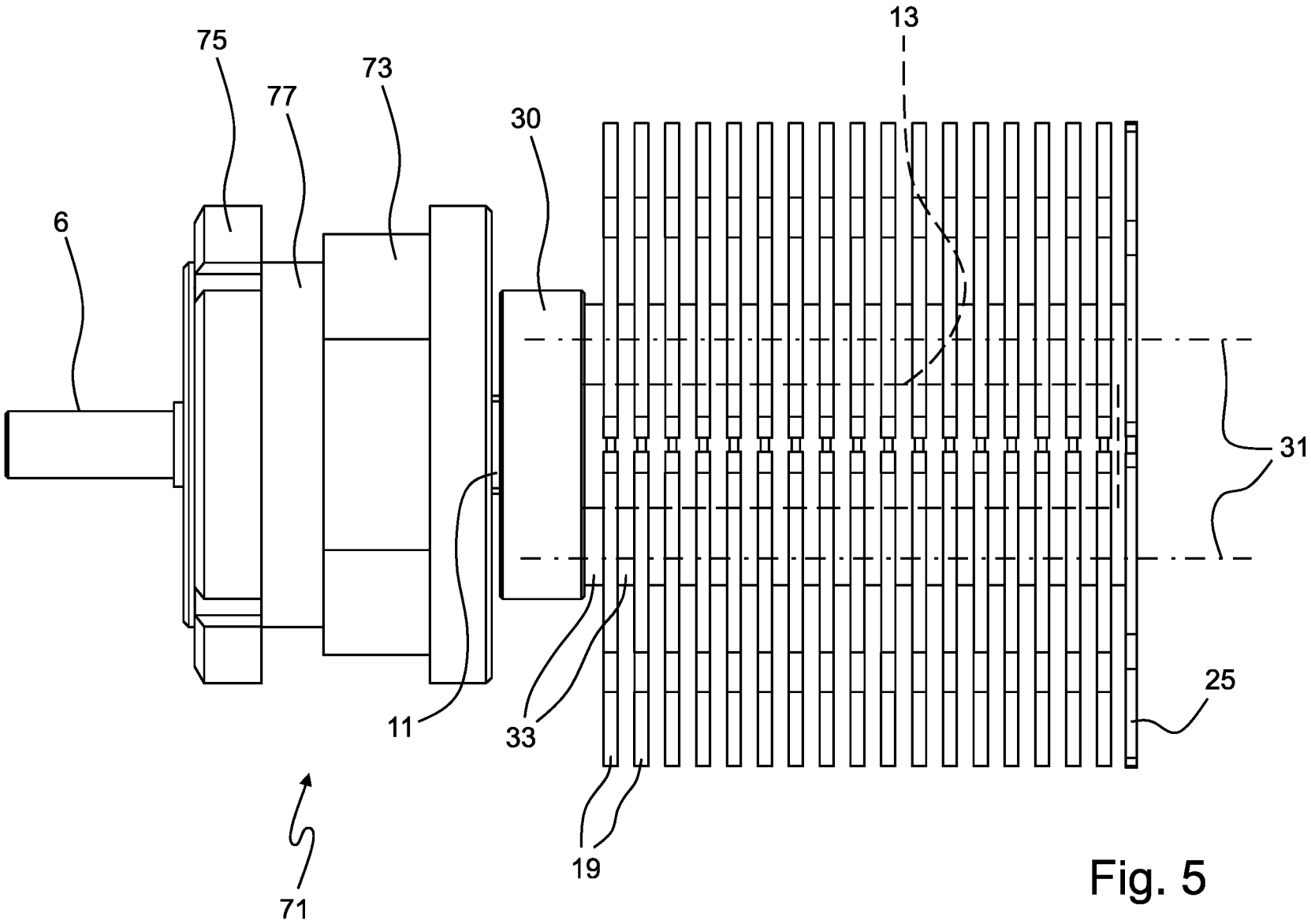
FIG. 5 shows the tool according to the present invention in the assembled state including saw blades and spacer rings.

As can be seen from FIG. 5, spacer rings 33 may be disposed between saw blades 19 and 25. These spacer rings 33 serve to adjust in the axial direction the desired distance between saw blades 19 among one another or between last saw blade 25 and adjacent saw blade 19. By using spacer rings 33 of different thickness, the number of saw blades 25 and thereby the required contact force can be adjusted for the removal of the surface. When axially spaced saw blades 25 immerse into the surface to be removed, webs, the width of which corresponds approximately to the thickness of spacer rings 33, remain. In this way, the width of the webs can also be adjusted via the thickness of spacer rings 33. As the width of the webs increases, the webs become more stable and it becomes increasingly more difficult to remove them from the substrate. Using the device according to the present invention, the webs during machining should simultaneously break and fall off the wall.

As a rule, the width of the webs is chosen as large as possible to minimize the contact force and the machining volume. However, it must be ensured that the webs do not become too wide. In order to optimally adjust tool 35 according to the present invention to different materials, a plurality of different spacer rings 33 can be chosen, which can be used as needed. In this instance, the optimal distances of saw blades 25 can be determined by tests on the surface to be removed.

It is important to note within the context of the present invention that the teeth of last saw blade 25 project in the axial direction furthest beyond drive shaft 1. This means that the teeth of last saw blade 25 are those components/elements of the tool according to the present invention, which in FIG. 5 project furthest to the right. No part of drive shaft 1, saw blade 25 or screws 31 projects further to the right in FIG. 5 than the saw teeth disposed at the outer diameter of last saw blade 25.

Within the context of the present invention, the term saw teeth is broadly defined. Usually, the term "saw tooth" is used if the tool has a cutting edge which is geometrically defined. Within the context of the present invention, saw blades 19, 25 can also be coated with diamond grains or other abrasively acting cutting materials. Then a removal of the surface is carried out using a geometrically undefined cutting edge. Typically, then one would talk of a grinding operation—rather than sawing; however, for configuring the tool according to the present invention, this is not relevant.

In FIG. 5, at the left end of drive shaft 1, a bearing block 71 is shown, which includes a section 73 having a hexagonal outer contour and a threaded section 77. A grooved nut 75 is screwed onto thread section 77. With the aid of grooved nut 77, bearing block 71 can be fastened by a suitable receptacle at a device 37 for the removal of surfaces according to the present invention.

Figure 6:
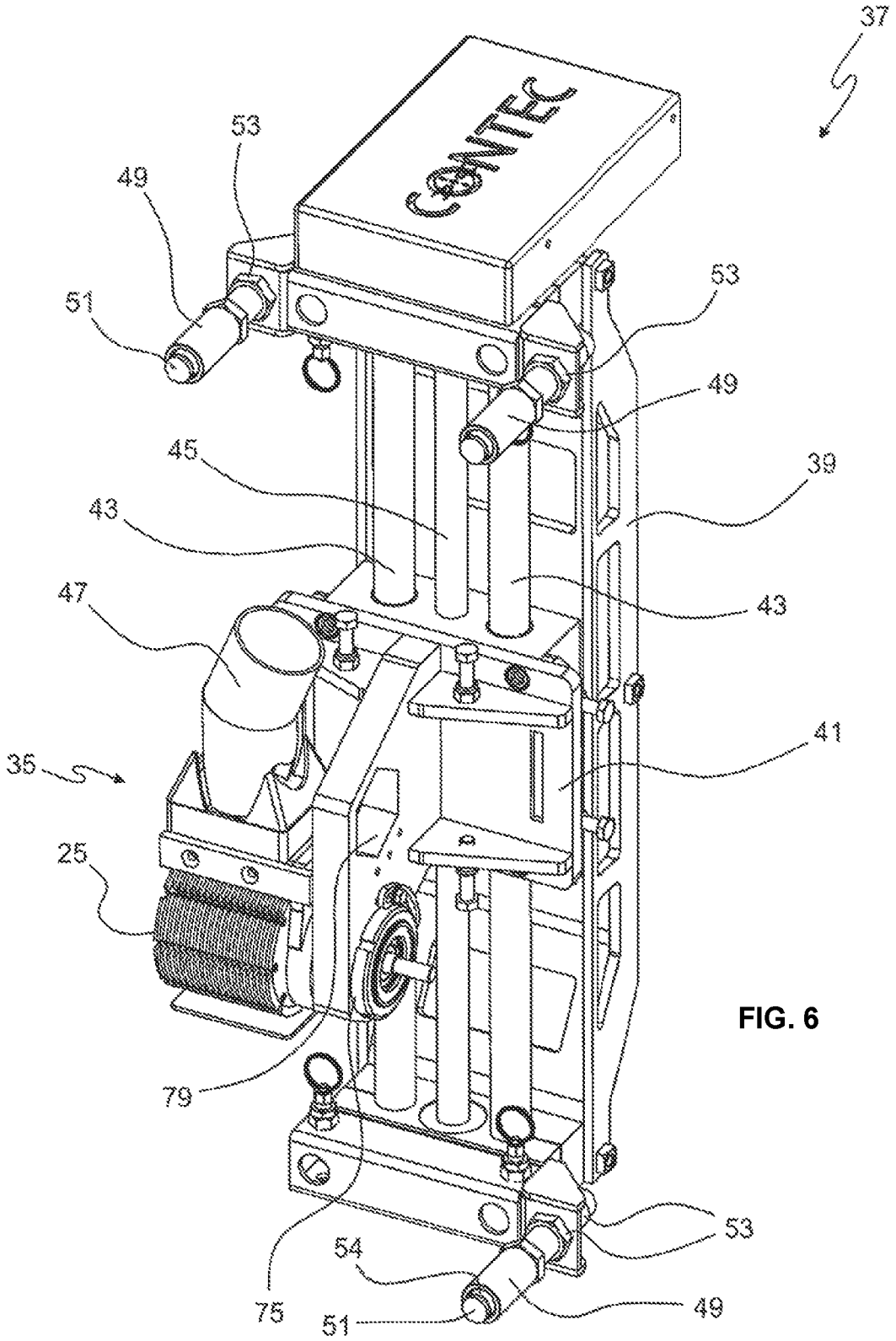
FIG. 6 shows an isometry of a device according to the present invention.

In FIG. 6, a device 37 for the removal of contaminated surfaces according to the present invention is illustrated isometrically. The tool according to the present invention, as illustrated in an exemplary manner in FIGS. 1 through 5, overall is denoted with reference character 35. Device 37 according to the present invention can be divided into the following components: a base frame 39, a sliding carriage 41, a linear guide 43 and a linear drive 45. A port for a dust extraction has been provided with reference numeral 47. The dust extraction encloses tool 35 as much as possible. For this reason, the dust extraction in some views obscures tool 35 in whole or in part.

Tool 35 according to the present invention is rotatably mounted on sliding carriage 41. For this purpose, bearing block 71 is used. In sliding carriage 41, a plurality of hexagonal breakthroughs 79 are present, which interact with section 73 of bearing block 71 having a hexagonal outer contour. If grooved nut 75 is wound onto threaded portion 77 of bearing block 71 and is tightened, bearing block 71, and by extension tool 35 according to the present invention, is firmly connected to sliding carriage 41. If sliding carriage 41, as shown, has a plurality of breakthroughs 79, then tool 35 can be installed in different places at the sliding carriage.

Optionally, sliding carriage 41 can have a (drive) motor, which directly or indirectly initiates a rotation of drive shaft 1 of tool 35. In the shown exemplary embodiment, tool 35 is actuated via a flexible shaft (not shown). In both alternatives, the actuator can be an electric motor, a hydraulic motor, a pneumatic drive, or another drive know from the prior art.

In FIG. 6, it can be clearly seen that a plurality of saw blades 19 and a last saw blade 25 are disposed at a relative short distance from one another at drive shaft 1 of tool 35. For reasons of clarity, only last saw blade 25, which in FIG. 6 is located at the left end of tool 35, is provided with reference numerals.

Linear drive 45 can be configured as a hydraulic double-acting cylinder, a double-acting pneumatic cylinder or an electromechanical linear drive.

As a basic principle, all robust drives 45 and linear guides 43 known from the prior art are suitable. The travel of sliding carriage 41 or of tool 35 can be adjusted via adjustable stops.

In base frame 39, three spacers 49 are disposed, which at its end facing away from base frame 49 may have a spring-loaded (spring) element 51. Spring-loaded spring element 51 can be a metal pin, which is guided in spacer 49 and which can be pressed against the force of a pressure spring disposed in spacer 49 (not visible) into the interior of spacer 49. Spacers 49 can also be configured without a spring element.

A stop of spacer 49 is denoted with reference character 54. Stop 54 defines the depth of immersion of tool 35 into the surface to be removed.

Preferably, spacers 49 are screwed to base frame 39 or inserted into base frame 39. For this reason, it is possible to easily adjust the height of spacers 49 in that nuts 53, by which spacers 49 are attached to base frame 39, are twisted. The isometry of FIG. 6 shows only little of nut 53 which is respectively in the back in FIG. 6.

Figure 7:
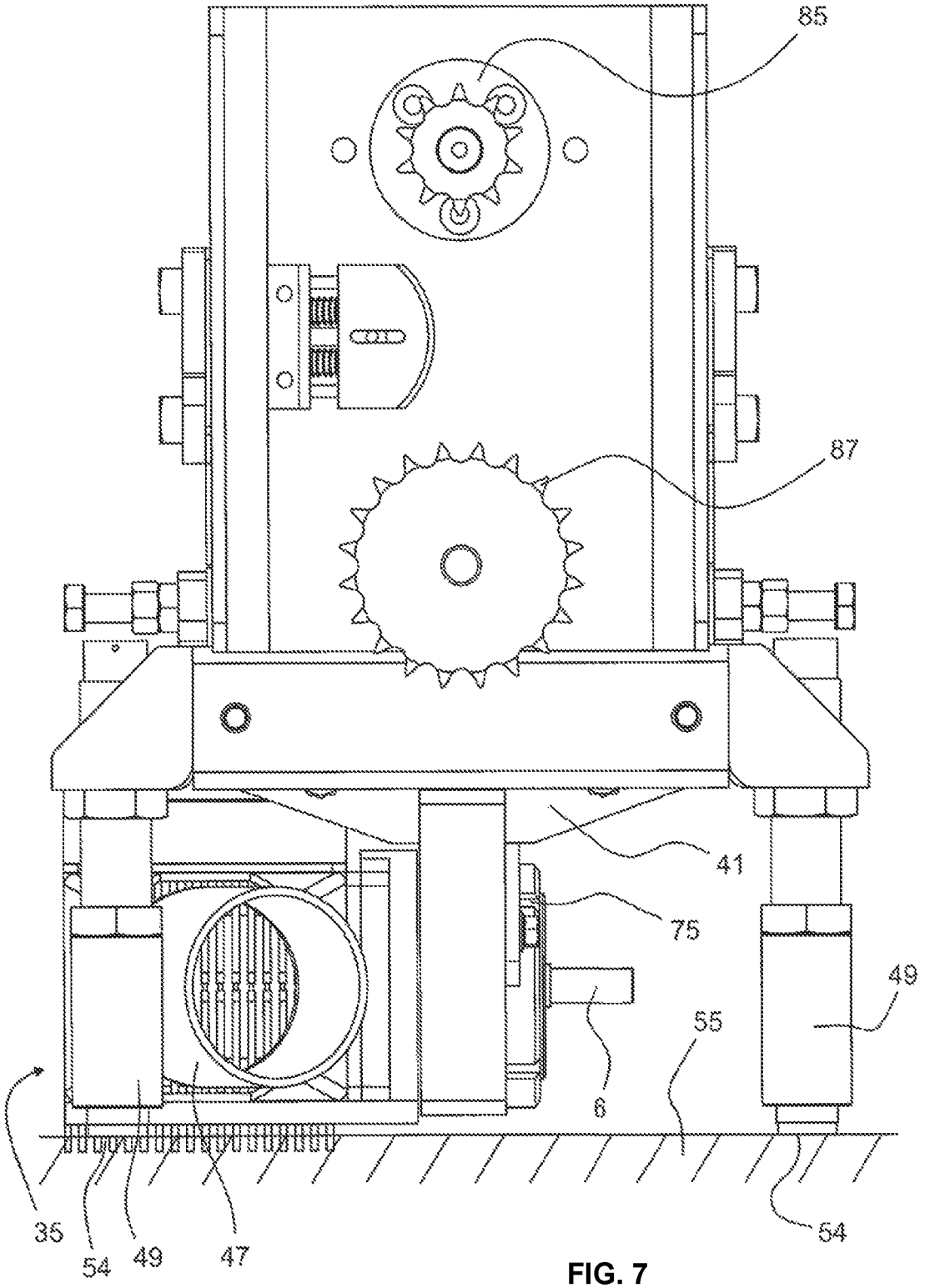
FIG. 7 shows a bottom view onto the device according to the present invention.

FIG. 7 shows a bottom view onto device 37 according to the present invention. This view allows to clearly recognize important geometrical relations.

In particular, it results that spacers 49 by their stops 54 project beyond the outer diameter of saw blades 19 and of last saw blade 25. In FIG. 7, this is illustrated by a line which connects stops 54. Thus, if device 37 by stops 51 is placed on a surface to be removed represented by the mentioned connecting line, then saw blades 19, 25 immerse into the surface.

If the device is pressed against the force of spring element 51 further in the direction of the surface, then saw blades 19, 25 immerse into surface 55 to be removed, because stops 54 are positioned so that saw blades 19 and 25 project beyond them.

In other words: if device 37 according to the present invention is gently placed onto a surface 55 to be machined using spring elements 51, saw blades 19 and 25 can still rotate freely; they are not yet in engagement with surface 55 to be machined.

If now the device according to the invention is pressed against spring elements 51 onto surface 55 to be machined until the stops of spacers 49 rest on surface 55, saw blades 19 and 25 immerse into surface 55 to be machined.

This two-stage use in the first step enables the positioning of the device according to the present invention in the desired location. Then tool 35 is rotated and, in a further step, device 37 is placed by hard ends 54 of spacer 49 onto surface 55 to be machined. Adjusting the length of spacers 49 by re-adjusting nuts 53 can be affected very easily. In so doing, the immersion depth of saw blades 19 and 25 is adjusted.

In FIG. 7, a drive 85 having a first pinion and a second pinion 87 spaced apart therefrom can be seen. A chain connecting the first and the second pinion 87 is not shown. Second pinion 87 actuates a threaded spindle, which in this embodiment forms linear drive 45 for carriage 43. In FIG. 6, drive 85 and second pinion 87 are covered by a cover.

Figure 8:
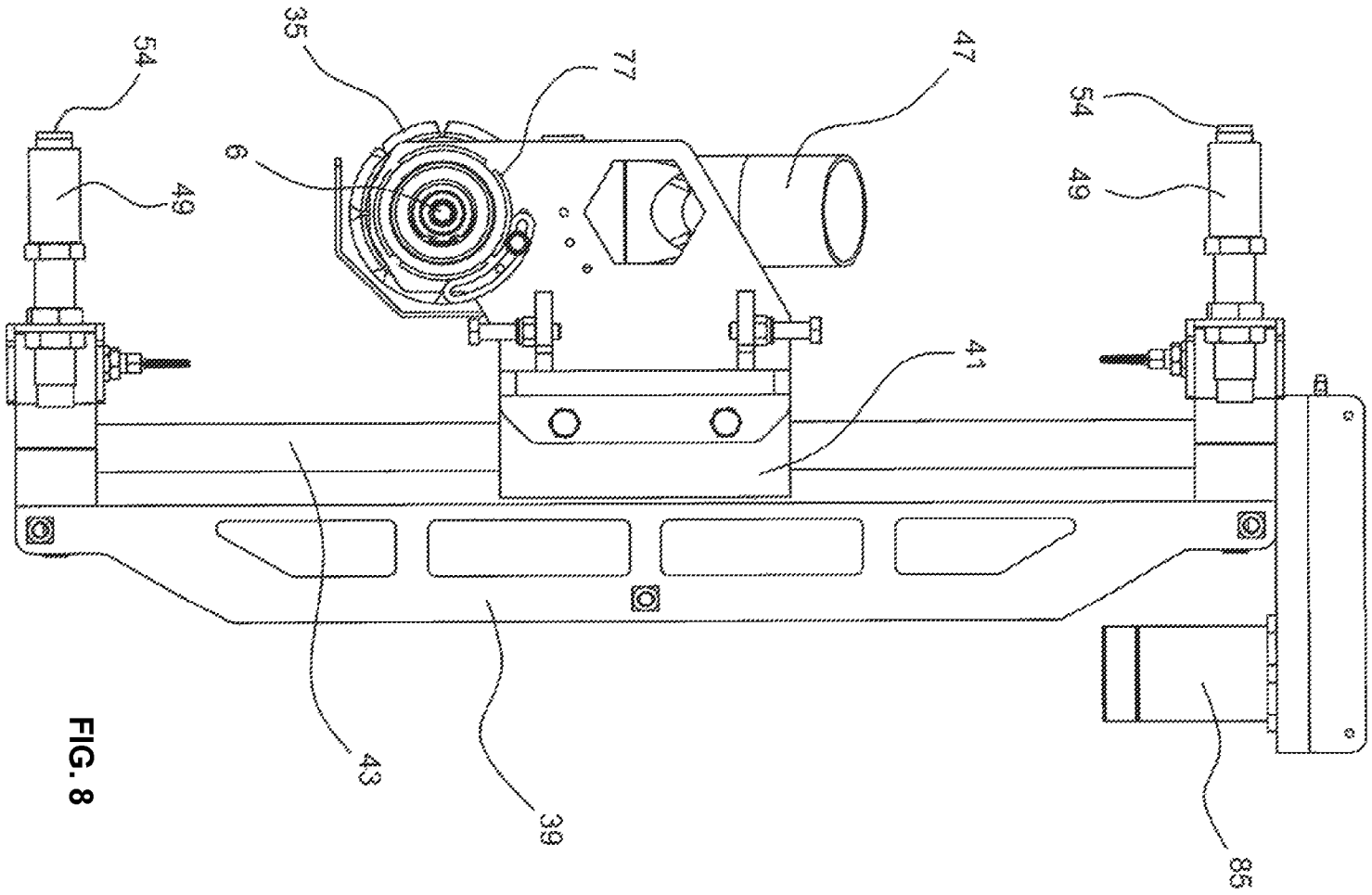
FIG. 8 shows a side view from the right of the device according to the present invention.

FIG. 8 shows a side view of device 37 according to the present invention. In this figure, drive 85 can be clearly seen. It becomes evident from this side view that spacers 49 having optional spring elements 51 and stops 54 facilitate the positioning and immersion of saw blades 19 and 25 into surface 55 to be machined.

In FIG. 8, sliding carriage 41, and so does tool 35, approximately in the middle of the movement path. In FIG. 8, a first end position is at the lower end of base frame 39. If tool 35 is located in the opposite end position (at the upper end of base frame 39 in FIG. 8), saw blades 19, 25 project beyond base frame 39. The contour of saw blades 19, 25 is indicated by a dashed line.

It is intended to make clear that tool 35 can be moved with the aid of device 37 according to the present invention into the corner between two surfaces 55 situated adjacent to each other.

At the (back) side of base frame 39 opposite of tool 35, a mechanical interface 57 is provided. With the help of this mechanical interface (57), it is possible to attach device 37 according to the present invention, for example, to an excavator arm or a robot arm and then to move device 37 with the help of this excavator arm or robot arm to the desired location and to keep it in that place during the machining of surfaces 55. Using an excavator or robotic arm, their functions can be used for the removal of surface 55, and device 37 according to the present invention can be kept structurally simple. Particularly preferably, interface 57 is designed so that device 37 can be rotatably (and lockably) attached by 360° to interface 57. Then, the working or feed direction of device 37 can be adjusted in the simplest manner.

Figure 9:
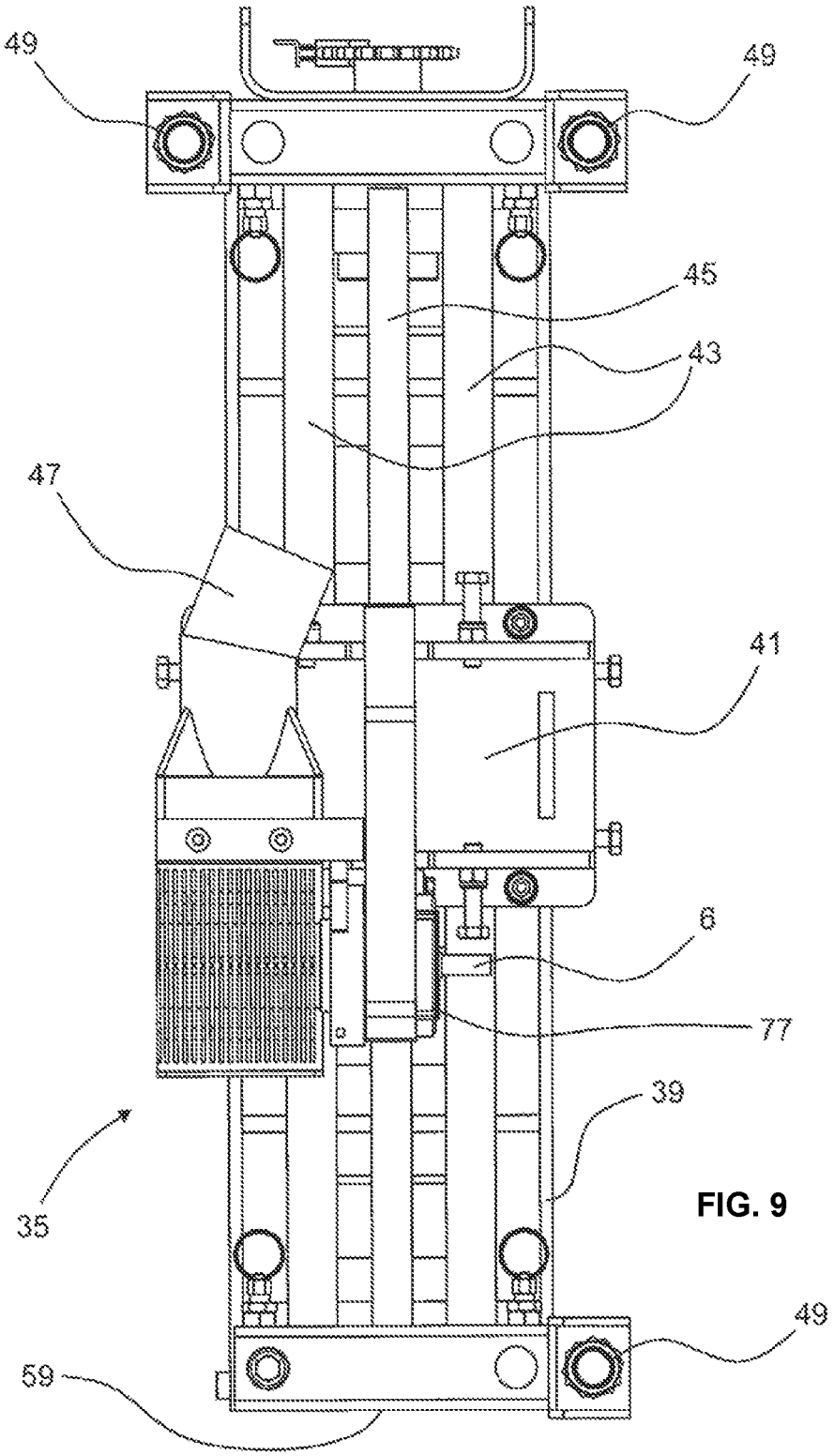
FIG. 9 shows a front view of the device according to the present invention.

FIG. 9 shows a device 37 according to the present invention in a front view. In this view, drive shaft 11 of the tool, having various saw blades 19 and 25, can clearly be seen. This view also makes it evident that there are three spacers 49. In the upper left-hand corner of the device in FIG. 9, no spacer is provided so that tool 35 can be moved beyond an end face 59 of base frame 39. Spacers 49 can be inserted into base frame 39 or can be attached, for example using nuts 53, to base frame 39 so that they can always be installed or [removed] as needed.

In this figure, it also becomes evident that tool 35 in the axial direction projects beyond a longitudinal side 61 of base frame 39. In this way, it is possible to remove the surface all the way into the corners of a room.

Figure 10:
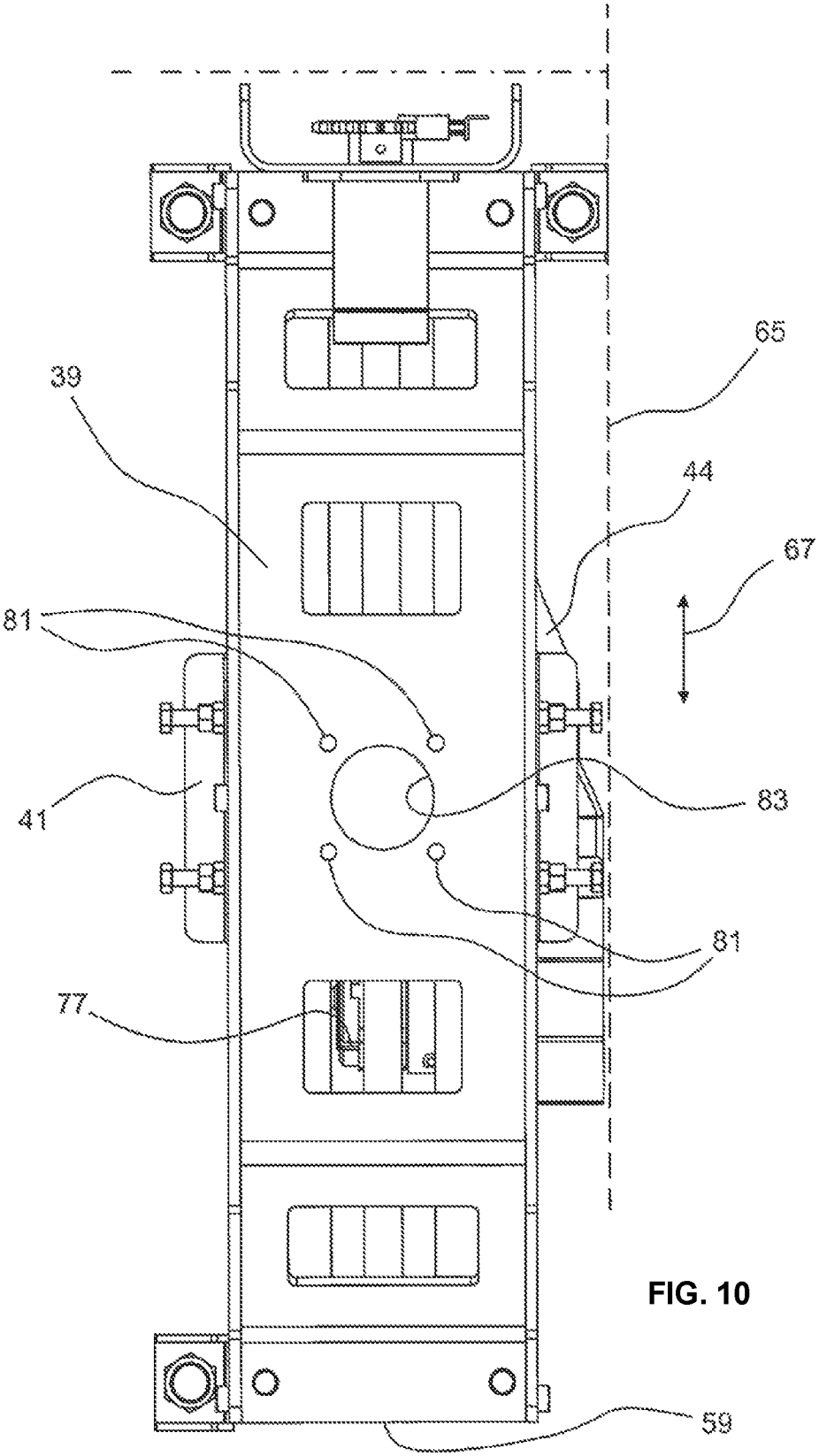
FIG. 10 shows a rear view onto the device according to the present invention.

FIG. 10 shows the device according to the present invention in a rear view not having a mechanical interface. Only four fastening holes 81 and one central breakthrough 83 can be seen. Supply lines are guided through breakthrough 83. A mechanical interface is screwed to fastening holes 81.

For example, all mechanical interfaces known from the field of construction machinery can be used as mechanical interface. It is particularly preferable if such an interface enables device 37 to rotate by up to 360°.

The device according to the present invention is often fastened to the arm of an excavator. For this purpose, one uses the mechanical interfaces established for excavators.

In FIG. 10, a working area of the tool (35) is indicated by a dash-dotted line 65. The feed direction of sliding carriage 41 in relation to base frame 39 is indicated by a double arrow 67.

Figure 11:
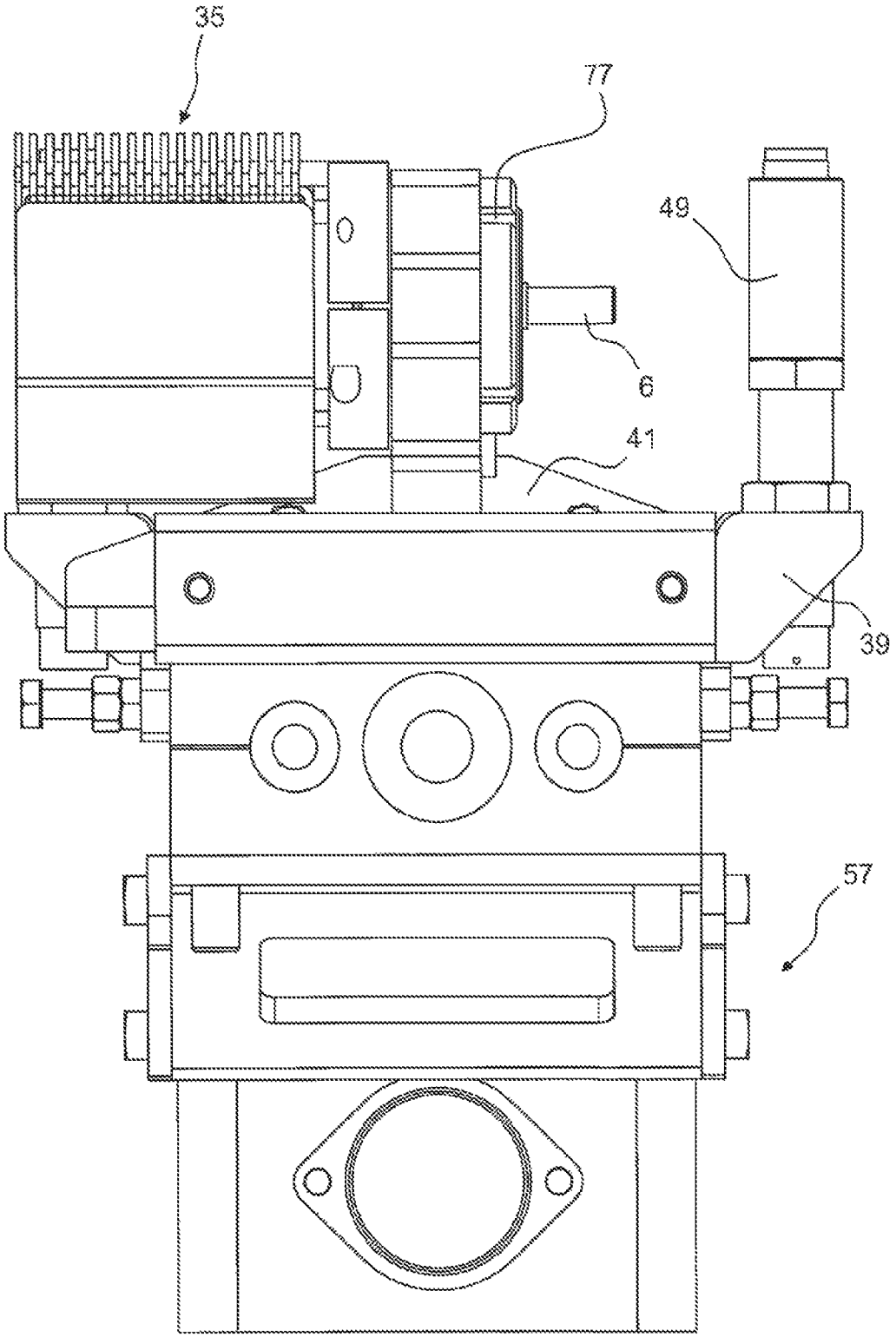
FIG. 11 shows a top view onto the device according to the present invention.

In FIG. 11, which shows a top view of device 37 according to the present invention, such a mechanical interface 57 is illustrated.

Figure 12:
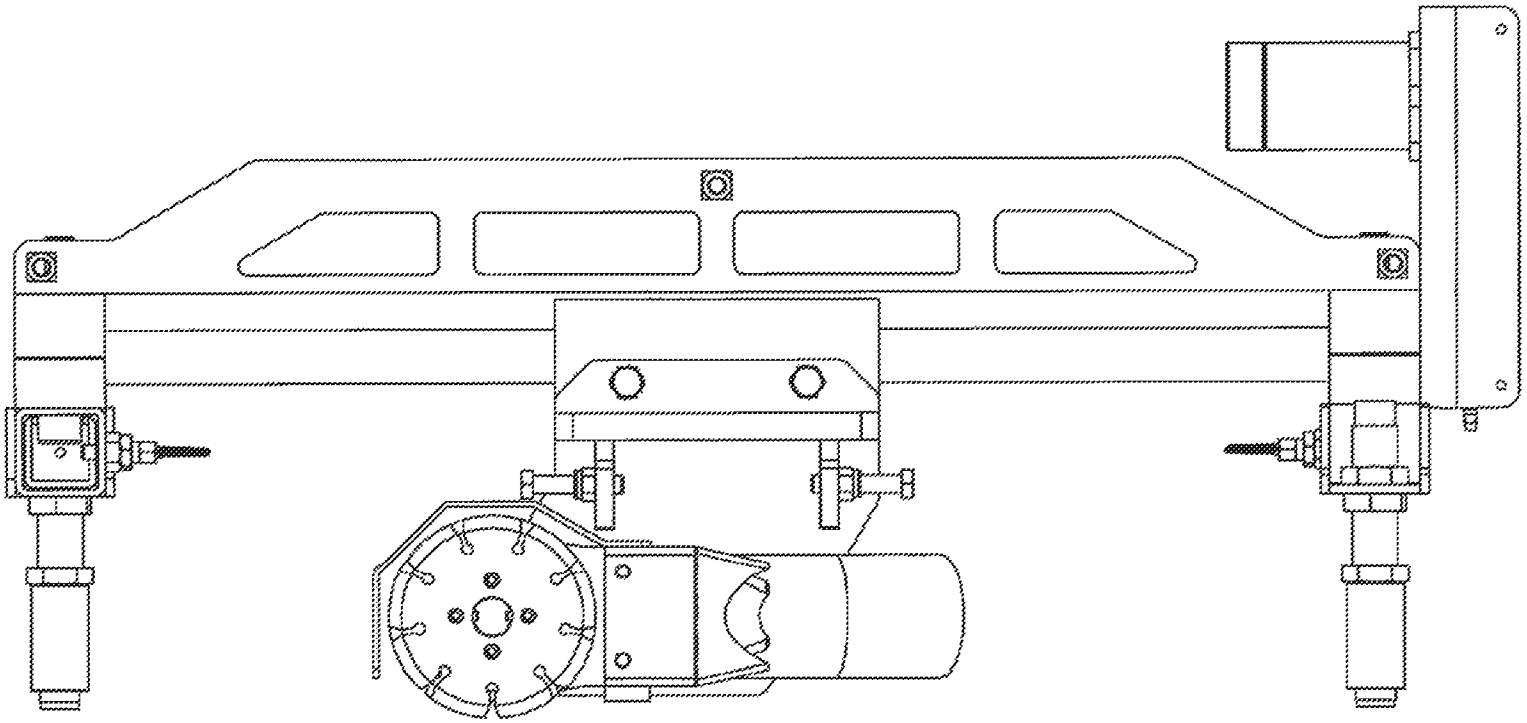
FIG. 12 shows a side view from the left of the device according to the present invention.

FIG. 12 shows a side view from the left.

Figure 13:
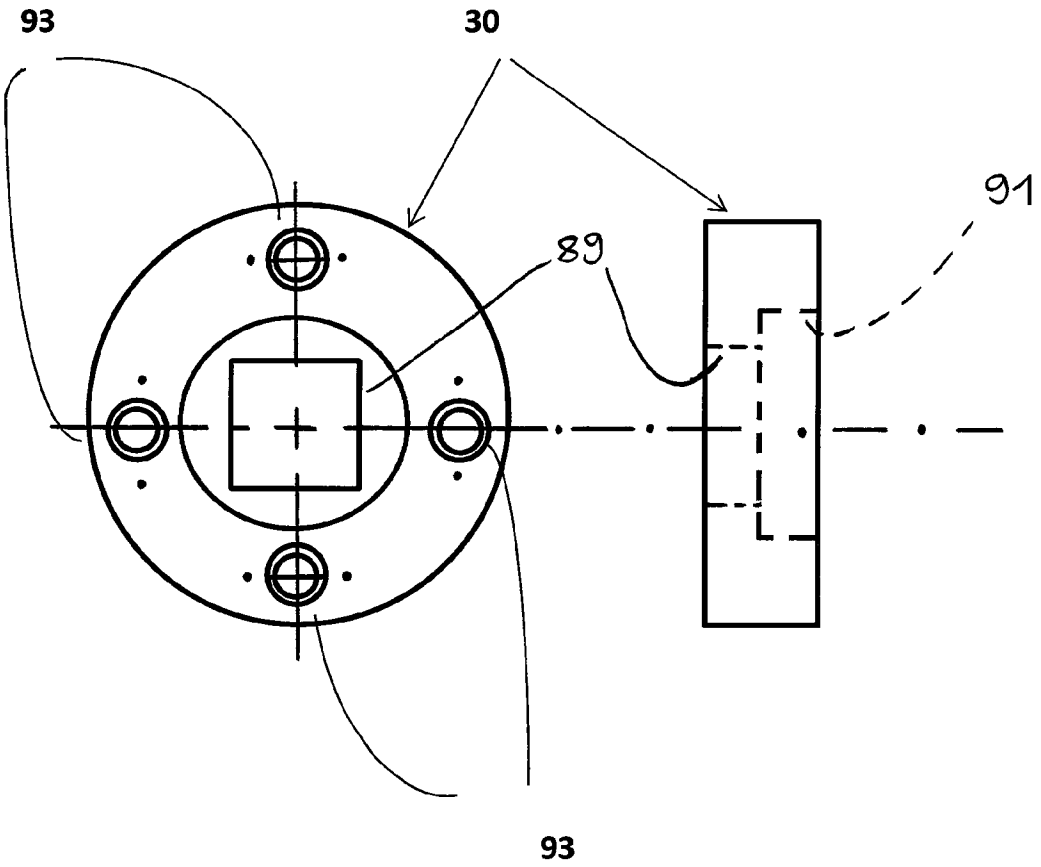
FIG. 13 shows an embodiment of a clamping piece.

In FIG. 13, a clamping piece 30 is shown. The clamping piece has a central breakthrough 89, which is matched in terms of shape and dimensions in the illustrated embodiment to optional square 11 of drive shaft 1. Here, breakthrough 89 is formed as a square breakthrough.

A recess 91, which is matched in terms of shape and dimensions in the illustrated embodiment to collar 17 of drive shaft 1, is formed concentrically to breakthrough 89. This means that the clamping piece in FIG. 5 is slid onto drive shaft 1 from the left and that collar 17 forms an axial stop for clamping piece 30.

In clamping piece 30, internal threads 93 are configured, the position of which corresponds to the position of through hole 29 of saw blades 25 and spacer rings 33. In order to connect saw blades 19 and 25 in a rotationally fixed and axially fixed manner to drive shaft 1, clamping screws 31 indicated in FIG. 5 are inserted through saw blade 25 and saw blades 19 and through spacer rings 33 and are screwed into internal threads 93 of clamping piece 30.

In an alternative embodiment (not illustrated), clamping piece 30 and drive shaft 1 are configured as a single piece. This means that collar 17 has a greater diameter than illustrated in FIG. 1 and takes over the function of the clamping piece. Internal threads 93 are then located within collar 17.

What is claimed is:

1. A device for the removal of surfaces to an immersion depth, comprising a base frame, a linear guide and a sliding carriage, wherein the sliding carriage is coupled via the linear guide to the base frame, characterized in that a tool for the removal of surfaces comprises a drive shaft, wherein the drive shaft is rotatably mounted at a first end, wherein a plurality of circular saw blades each having saw teeth are disposed at the drive shaft, and wherein the saw teeth of a last saw blade disposed at a second end of the drive shaft opposite of the first end project in the axial direction beyond the second end of the drive shaft wherein the saw blades are connected to the drive shaft in a rotationally fixed manner, wherein the drive shaft comprises at least one longitudinal groove and a collar, wherein spacer rings are disposed between the saw blades, and wherein the spacer rings and the saw blades have through holes and a central opening, wherein at least one lug is configured and positioned at the central openings of the spacer rings, and that the at least one lug is formed in a complementary manner to the at least one longitudinal groove of the drive shaft, and the base frame has a plurality of spacers each including a stop.

2. The device as recited in claim 1, characterized in that a bearing block for the tool is provided at the sliding carriage.

3. The device as recited in claim 1, characterized in that a linear drive for moving the sliding carriage in relation to the base frame is provided.

4. The device as recited in one of claim 1, characterized in that the shaft laterally projects beyond the base frame.

5. The device as recited in claim 1, characterized in that at least a portion of the saw blades project beyond an end face of the base frame.

6. The device as recited in claim 1, characterized in that the base frame has a mechanical interface.

7. The device as recited in claim 6, characterized in that the mechanical interface interacts with a mechanical interface at a construction machine.

8. The device as recited in claim 1, characterized in that the spacers respectively have one spring element and that a spring deflection of the spring elements is greater than the immersion depth.

9. The device as recited in claim 8, characterized in that a length of the spacers is dimensioned in such a manner that, if the spring element in the decompressed state rests on the surface to be removed, the saw blades of the tool do not immerse into the surface to be removed.

* * * * *